United States Patent [19]

Kong

[11] Patent Number: 4,865,342

[45] Date of Patent: Sep. 12, 1989

[54] ROLLER SKATING BOARD

[76] Inventor: Jin Y. Kong, 371 Hwanghak-dong, Jung-qu, Seoul, Rep. of Korea

[21] Appl. No.: 278,053

[22] Filed: Nov. 30, 1988

[30] Foreign Application Priority Data

Apr. 28, 1988 [KR] Rep. of Korea ..... 88-6044

[51] Int. Cl.[4] ..... A63C 17/04

[52] U.S. Cl. ..... 280/87.042

[58] Field of Search ..... 280/87.041, 87.042, 280/63, 11.115, 11.12, 11.14, 11.15, 11.2, 11.23

[56] References Cited

U.S. PATENT DOCUMENTS 3,671,055 6/1972 Aarup ..... 280/87.042

4,460,187 7/1984 Shimuzu ..... 280/87.042

*Primary Examiner*—Charles A. Marmor

*Assistant Examiner*—Richard Cambey

*Attorney, Agent, or Firm*—Helfgott & Karas

[57] ABSTRACT

A skating board has a pair of concave shoe forms at opposite sides of a plate along a longitudinal center line to maintain the users feet positioned in the forms. If the user wants to stop the board, he raises the front of the board and thus engages the rear brake with the ground.

1 Claim, 2 Drawing Sheets

ROLLER SKATING BOARD

BACKGROUND OF THE INVENTION

The present invention relates generally to roller skating board.

In general, it is well known roller skates attached under a sole, and a skating board having a plate and rollers, and a sled having sliding plates or blades under the opposite sides of a plate which can provide a sliding safety. Furthermore, it is a well known skating board having a plurality of rollers under a plate and a sail on the said plate and being moved by a wind power.

However, the above prior embodiments have some disadvantages that the feet are able to be slided out of a plate and it does not prevent the plate from bending because there is no supporter under the plate to prevent the bending.

Accordingly, it is the main object of the present invention to provide an improved roller skating board to solve the problems found in prior embodiments.

SUMMARY OF THE INVENTION

The skating board according to the present invention has a pair of concave shoes forms at the opposite sides of the plate along a horizontal line to maintain the foot position in the forms fixedly by a flange portion extended from a front portion of the shoe forms. If a user wants to stop the board, he raises the front portion of his foot so that the plate may be biased to be raised at the front portion by his weight, thereby the brake portion attached at the rear portion of the plate contacts with the ground surface to stop the board. Under the plate, a pair of triangular supporters are fixed along a horizontal line to support the weight of the user imposed on the plate. An axle of the main roller is inserted into rectangular holes formed in the wall of said supporters. Furthermore, a T-shaped brake portion is attached under the plate in rear portion by a housing, the brake portion can be easily removed by a simple operation.

In using the board according to the Invention, the user positions his feet into the shoes forms, and bends his knees, thereafter, pulls the sticks against the ground surface, and then the free and main rollers start to roll, and the board can be maintained centripetally. If the user wants to stop the board, he may raise the front portions of his feet, thereby the front portion of the plate can be raised so that the brake portion may contact with the ground surface to stop the board.

The features and advantages of the present invention will become more apparent from the following description and accompanying drawings.

DETAILED DESCRIPTION OF THE PREFERRED EMBODIMENT

Figure 1:
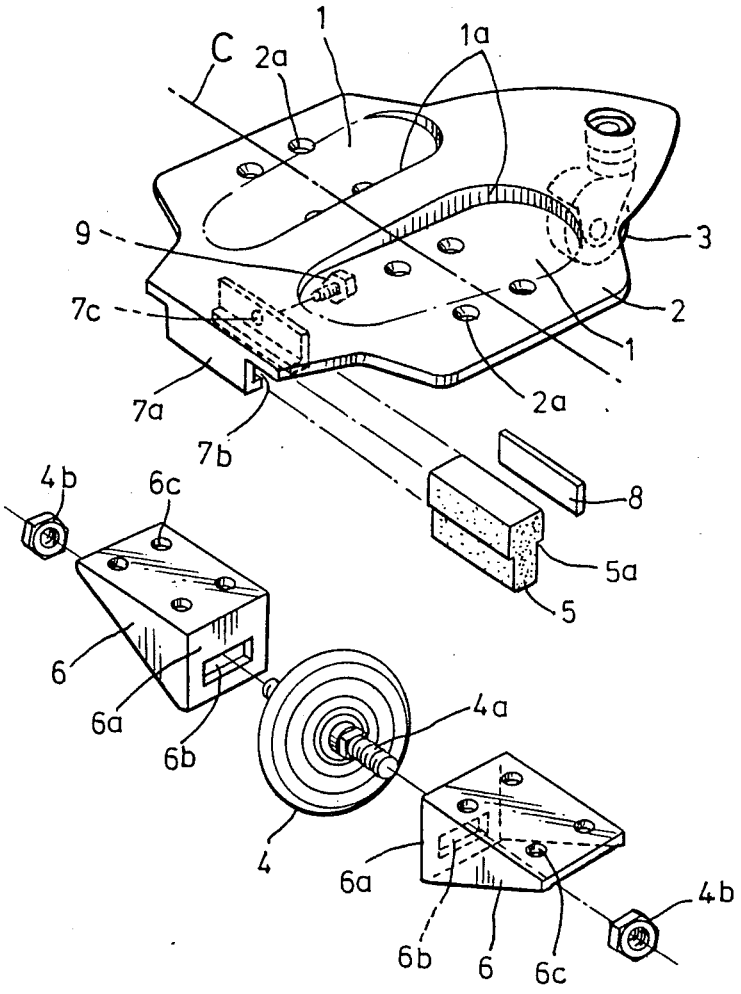
FIG. 1 is a perspective view in taking to pieces of a skating board in accordance with the present invention
Figure 2:
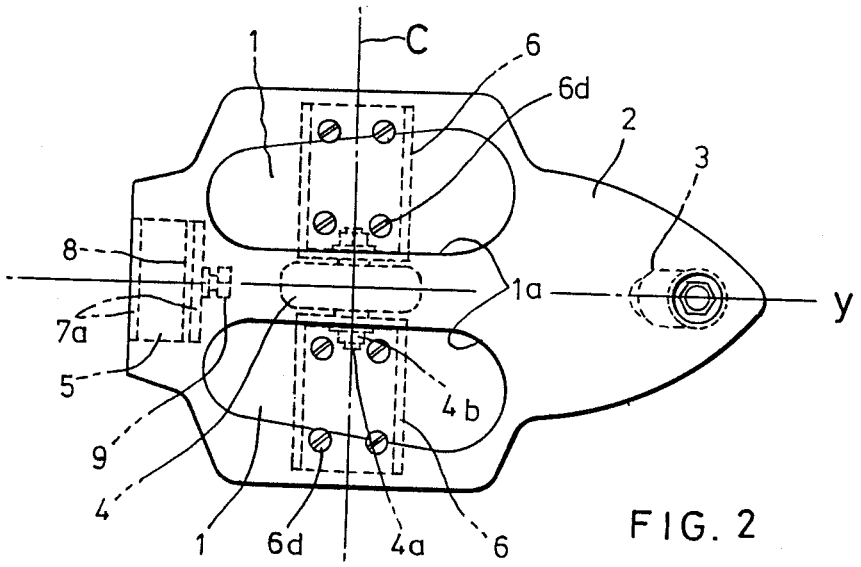
FIG. 2 is a pla n view of the skating board in accordance with the present invention in assembly.
Figure 3:
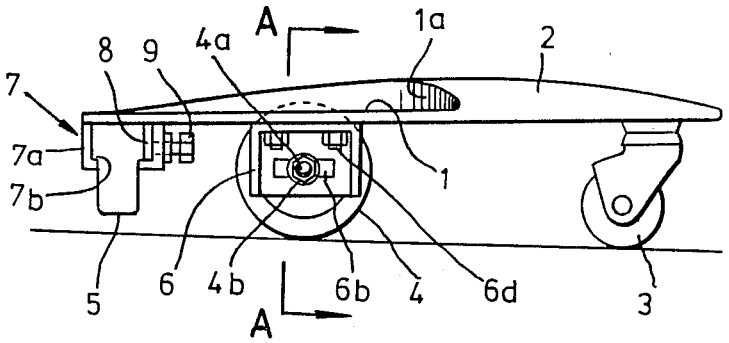
FIG. 3 is a side view of skating board shown in FIG. 2.
Figure 4:
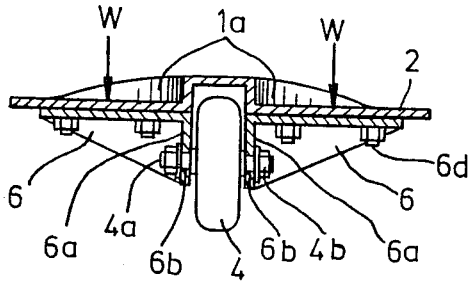
FIG. 4 is a sectional view of the skating board shown along the A—A in FIG. 3.

Referring to FIGS. 1 to 4, a pair of shoe forms (1) are formed on the upper surface of the plate (2) concavely, and a free roller (3), a main roller (4) and a brake portion (5) are all attached under the plate (2). The free and main rollers (3,4) and brake portion (5) are all positioned along a center line (y). A flange portion (1) is extended from the front portion of the shoe forms (1), and a pair of triangular supporters (6) having a rectangular holes (6*b*) formed in a wall (6*a*) are attached under the plate (2) by plurality of bolts and nuts (6*d*). An axle (4*a*) of the main roller (4) is inserted into the rectangular holes (6*b*), and controlled forwardly or backwardly, there after, fixed by a pair of nuts (4b), a brake portion (5) is fixed in a housing (7) which is composed of a pair of parallel walls (7*a*) having a fange (7*b*). In fixing the brake portion (5) into the housing (7), a T-shaped brake portion (5) is forcedly inserted from a side open portion of the housing (7) along with a sub-plate (8), there after, a bolt (9) is inserted into a threaded hole (7*c*) formed in a wall (7*a*) to press the sub-plate (8) against the brake portion (5).

In using, a user positions his feet into a pair of shoes forms (1) respectively, and bends his knees. In the above position, an width between the feet is maintained, and the feet are prevented from sliding out of the forms (1) by the extended flanges (1*a*) so that the center portion of the foot can be maintained on the horizontal line (c), and the weight of the user is imposed on the front portion of the plate (2), and the plate (2) is able to be inclined to right or left.

If the user pulls the sticks (not shown) against the ground surface in the above balanced position, the roller s (3,4) of which a free roller (3) can guide the moving direction, start to roll.

In rolling at a slope, if it is necessary to stop the board, the user raises the front portion of his foot so that his weight imposed on the front portion of the plate may be moved to the rear portion of the board to down the said rear portion and to contact the brake portion (5) with the ground surface, thereby the skating board can be stopped by a frictional power between the brake portion (5) and the ground surface. Accordingly, if the user can control the sliding movement of the board.

Because the rectangular hole (6*b*) formed in a wall surface (6*a*) of the respective supporters (6) can controllably receive an axle (4*a*) of the main roller (4) in forward or backward direction, the center position of the feet can be easily controlled according to a foot size of the user.

Furthermore, it is prevented from bending the opposite sides of the plate (2) down wardly, because the plate (2) is supported by the said supporters (6).

When the brake portion (5) is necessary to be replaced, one may release the bolt (9) and removes the brake portion (5) and the sub-plate (8), and inserts a new brake portion (5) along with the sub-plate (8), thereby, the flange (7*b*) contacts with a extruded portion (5*a*) of the brake portion (5) to prevent the brake portion (5) from being released.

The roller skating board according to the present invention offers so many advantages that it can be used independent of place or season, and controlled a sliding force by a simple operation, and made compact and at a lower cost.

What is claimed:

1. A roller skating board, comprising: a plate (2) having a top and bottom surface; a free roller (3) and a main roller (4) attached to said bottom surface of said plate (2) along a longitudinal center line (y); a pair of concave shoe forms (1) within said top surface of said plate each having a flange (1*a*) extending rearwardly from a respective front portion of said forms (1), a pair of triangular supporters (6) attached to the bottom surface of said plate (2) along a transverse line (c) by a plurality of bolts (6d) on opposite sides of said main roller (4), each said support (6) having a wall (6*a*) and a rectangular hole (6*b*) formed in said wall (6*a*) into which an axle (4*a*) of said main roller (4) is inserted, respectively; a housing (7) having a pair of walls (7*a*) and a pair of flanges (7*b*) attached to a portion of said bottom surface of said plate; a brake portion (5) inserted into said housing (7) along with a subplate (8) fixed to said housing by a bolt.

* * * * *